US008079114B2

(12) United States Patent
Fries et al.

(10) Patent No.: US 8,079,114 B2
(45) Date of Patent: Dec. 20, 2011

(54) HEIGHT ADJUSTMENT DEVICE FOR A HINGE

(75) Inventors: Bror Fries, Hishult (SE); Frank W. Campbell, Lake Elmo, MN (US)

(73) Assignee: Creative Research & Development, Inc., Lake Elmo, MN (US)

( * ) Notice: Subject to any disclaimer, the term of this patent is extended or adjusted under 35 U.S.C. 154(b) by 529 days.

(21) Appl. No.: 12/245,130

(22) Filed: Oct. 3, 2008

(65) Prior Publication Data

US 2009/0089974 A1 Apr. 9, 2009

Related U.S. Application Data

(63) Continuation-in-part of application No. PCT/NO2007/000119, filed on Mar. 29, 2007.

(30) Foreign Application Priority Data

Apr. 5, 2006 (NO) ..... 20061548

(51) Int. Cl.
*E05D 7/04* (2006.01)

(52) U.S. Cl. ..... 16/243; 16/235; 16/242; 16/248; 16/271; 16/312; 16/315; 16/328

(58) Field of Classification Search ..... 16/232, 16/235, 238, 240, 242, 243, 248, 271, 272, 16/310, 312, 315, 328
See application file for complete search history.

(56) References Cited

U.S. PATENT DOCUMENTS

| | | | | |
|---|---|---|---|---|
| 2,844,842 | A * | 7/1958 | Neilson | 16/367 |
| 2,872,697 | A * | 2/1959 | Hizsa, Jr. | 16/342 |
| 2,975,013 | A * | 3/1961 | Wallace et al. | 312/296 |
| 3,327,435 | A * | 6/1967 | Anderson | 52/27 |
| 5,339,493 | A * | 8/1994 | MacIntyre | 16/238 |
| 5,713,105 | A * | 2/1998 | Toomey | 16/245 |
| 5,799,370 | A * | 9/1998 | Davidian et al. | 16/236 |
| 6,643,895 | B1 * | 11/2003 | Domenig et al. | 16/238 |
| 6,715,181 | B1 | 4/2004 | Fries | |
| 6,880,205 | B2 * | 4/2005 | Rupprechter | 16/235 |
| 6,918,158 | B2 * | 7/2005 | Isele | 16/235 |
| 7,017,231 | B2 * | 3/2006 | Isele | 16/242 |
| 7,350,272 | B2 * | 4/2008 | Fries | 16/246 |
| 7,516,517 | B2 * | 4/2009 | Fries | 16/246 |
| 7,552,511 | B2 * | 6/2009 | Campbell et al. | 16/238 |
| 7,676,887 | B2 * | 3/2010 | Chung | 16/236 |
| 2008/0022491 | A1 * | 1/2008 | Campbell et al. | 16/236 |

FOREIGN PATENT DOCUMENTS

| | | |
|---|---|---|
| DE | 3701698 A1 | 8/1988 |
| EP | 1 241 308 A2 | 9/2002 |
| WO | WO 01/84261 A1 | 11/2001 |
| WO | WO 03/029589 A | 4/2003 |

* cited by examiner

*Primary Examiner* — Victor Batson
*Assistant Examiner* — Roberta Delisle
(74) *Attorney, Agent, or Firm* — IPLM Group, P.A.

(57) ABSTRACT

A height adjustment device for a hinge having one hinge leaf that can be snapped into or inserted into a receiving part mounted on a door leaf or on a door frame, and with a height adjustment mechanism in the receiving part which has abutment against an edge of the hinge leaf. The height adjustment mechanism has a slide that is limitedly movable in the receiving part, and a rotatable height adjustment member. The slide has a portion for abutment against an edge of the hinge leaf. The height adjustment member has a plurality of radially directed, angularly separated arms of different lengths, wherein an end portion of such an arm is adapted to engage with an adapted engaging portion of the slide.

22 Claims, 14 Drawing Sheets

HEIGHT ADJUSTMENT DEVICE FOR A HINGE

RELATED APPLICATIONS

This application is a continuation-in-part under 35 U.S.C. 111(a) of PCT/NO07/000119 filed Mar. 29, 2007 and published in English as WO 2007/114709 A1 on Oct. 11, 2007; which International Application claims priority from Norwegian Application No. 20061548, filed Apr. 5, 2006; these applications and publications are incorporated herein by reference.

BACKGROUND OF THE INVENTION

Some prior art devices of this kind are e.g. known from NO 309619, NO 318487 and WO 03/029589. Other types of adjustable devices are found e.g. in U.S. Pat. No. 5,799,370 and FR 2368596.

Earlier height adjustment devices have been found to have a number of limitations in as regards the range of possible height adjustment which is present within the available area. Many of these known devices also have a tendency to tip over and out of a set position and thus lose their bearing capacity in the set position.

SUMMARY OF THE INVENTION

In one embodiment the invention is a height adjustment device for a door hinge. The device is configured to be cooperative with the door hinge having hinge leaves attachable to a door leaf and a door frame, wherein a rotary height adjustment mechanism is configured to be installed on either the door leaf or the door frame to engage a dedicated one of the hinge leaves thereat. A height adjustment mechanism of the device, upon engagement, is adapted to bear against an adjacent, longitudinal edge on the dedicated one of the hinge leaves, and wherein the height adjustment mechanism includes a rotary height adjustment mechanism where with a plurality of selectable adjustment features located at respective different differences from a rotation center of the rotary height adjustment member. The rotary height adjustment mechanism includes a limitedly moveable slide and a rotary height adjustment member, wherein the slide has a first end configured for abutment against the longitudinal edge of the hinge leaf. The rotary height adjustment member is a rotor with a plurality of radially directed, angularly separated features of different lengths. The slide has a second end for abutting the angularly separated features, the second end having an extension member that extends beyond the second end. The second end is opposite the first end. An end portion of such a feature, upon rotation of the rotary height adjustment member to a required rotary position is adapted to abut the extension member.

In another embodiment, the invention is a height adjustment device for a door hinge. The device is configured to be cooperative with the door hinge having hinge leaves attachable to a door leaf and a door frame, wherein a rotary height adjustment mechanism is configured to be installed on either the door leaf or the door frame to engage a dedicated one of the hinge leaves thereat. A height adjustment mechanism of the device, upon engagement, is adapted to bear against an adjacent, longitudinal edge on the dedicated one of the hinge leaves, and wherein the height adjustment mechanism includes a rotary height adjustment mechanism where with a plurality of selectable adjustment features located at respective different differences from a rotation center of the rotary height adjustment member. The rotary height adjustment mechanism includes a limitedly moveable slide and a rotary height adjustment member, wherein the slide has a first end configured for abutment against the longitudinal edge of the hinge leaf. The rotary height adjustment member has a rotor with a plurality of radially directed, angularly separated features of different lengths, wherein an end portion of such a feature, upon rotation of the rotary height adjustment member to a required rotary position, is adapted to releaseably engage with an engaging portion at a second end of the slide that is opposite the first end of the slide.

DETAILED DESCRIPTION OF A PREFERRED EMBODIMENT

Although basically the invention is utilisable for height adjustment of hinges where the hinge leaves of the hinge are both fastened with screws to a door leaf and a door frame respectively, the present invention is first and foremost described for a hinge of the snap-in type, wherein a first of the hinge's hinge leaves can be snapped into a receiving part mounted on a door leaf and a second hinge leaf is attachable to an adapted door frame, and wherein a height adjustment mechanism is fitted in the receiving part and is adapted to bear against an adjacent, longitudinal edge on said first hinge leaf.

It is also conceivable that a first of the hinge's hinge leaves is attachable to a door leaf and a second hinge leaf can be snapped into a receiving part mounted on an adapted door frame, and wherein a height adjustment mechanism is fitted in the receiving part and adapted to bear against an adjacent, longitudinal edge on said second hinge leaf.

Figure 1:
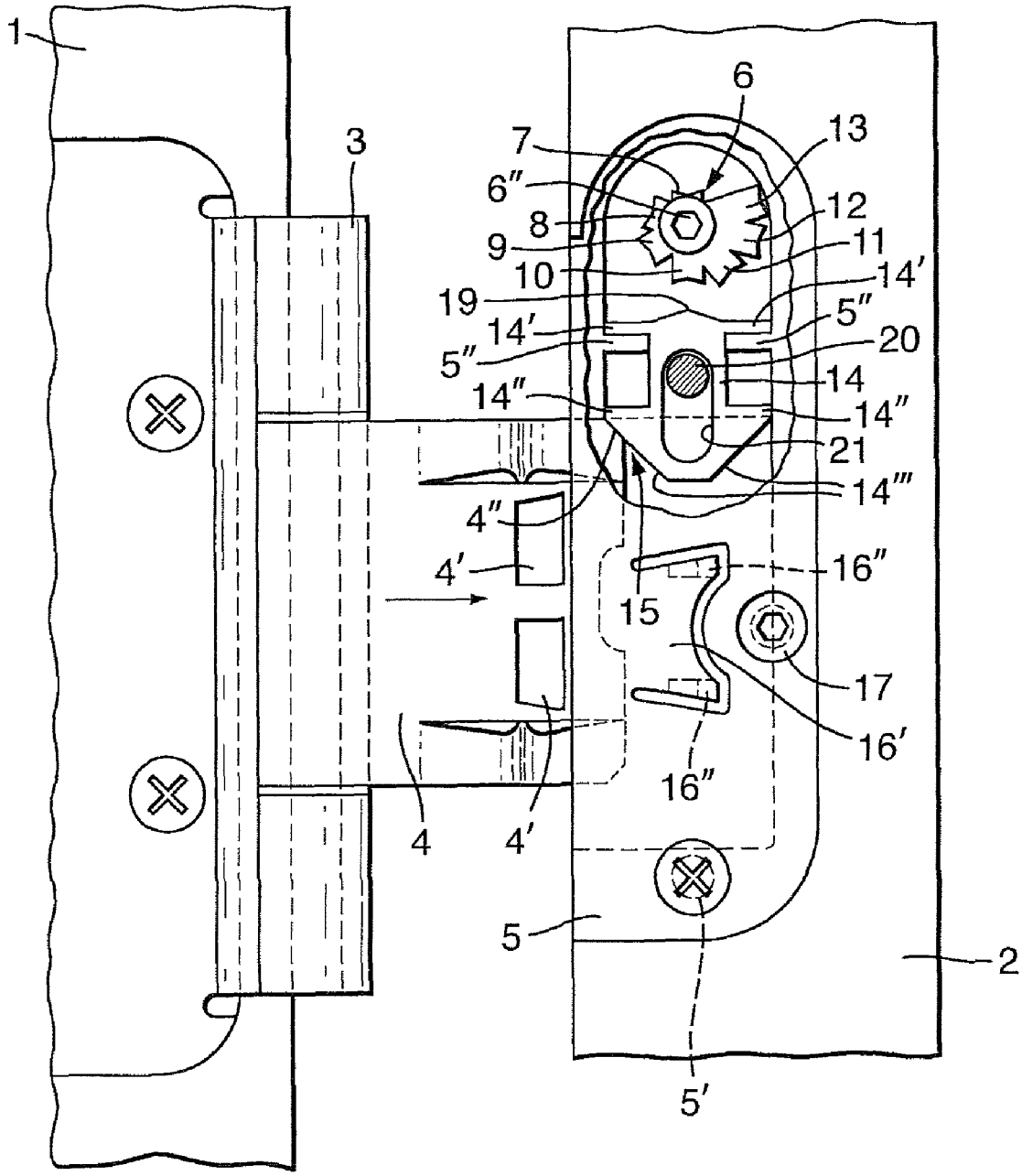
FIGS. 1 and 2 show a hinge for heavy doors that is adjustable vertically and laterally, FIG. 2*a* showing vertical or height adjustment and FIG. 2*b* (prior art) showing the principle of lateral or sideways adjustment.

FIG. 1 shows a door frame 1 and a door 2 with a hinge 3, the hinge 3 having a hinge leaf 4 configured as an insertion tongue for insertion into a receiving part 5 and its operational components. A rod-shaped "rotor" 6 is shown having a plurality of rods or pins 7-13. The rods or pins are provided outermost with a recess, for example, having a pointed or curved shape, i.e., a V or a U shape, or a right-angled shape, as e.g. indicated by 10" or 13" in FIG. 4*a*. The rod rotor 6 has a center of rotation from which the rods 7-13 extend. The number of rods and their length may be variable, as required. The reference numeral 6" indicates a notch for a rotary tool. The turning of the rotor 6 permits a stepwise height adjustment.

Figure 2A:
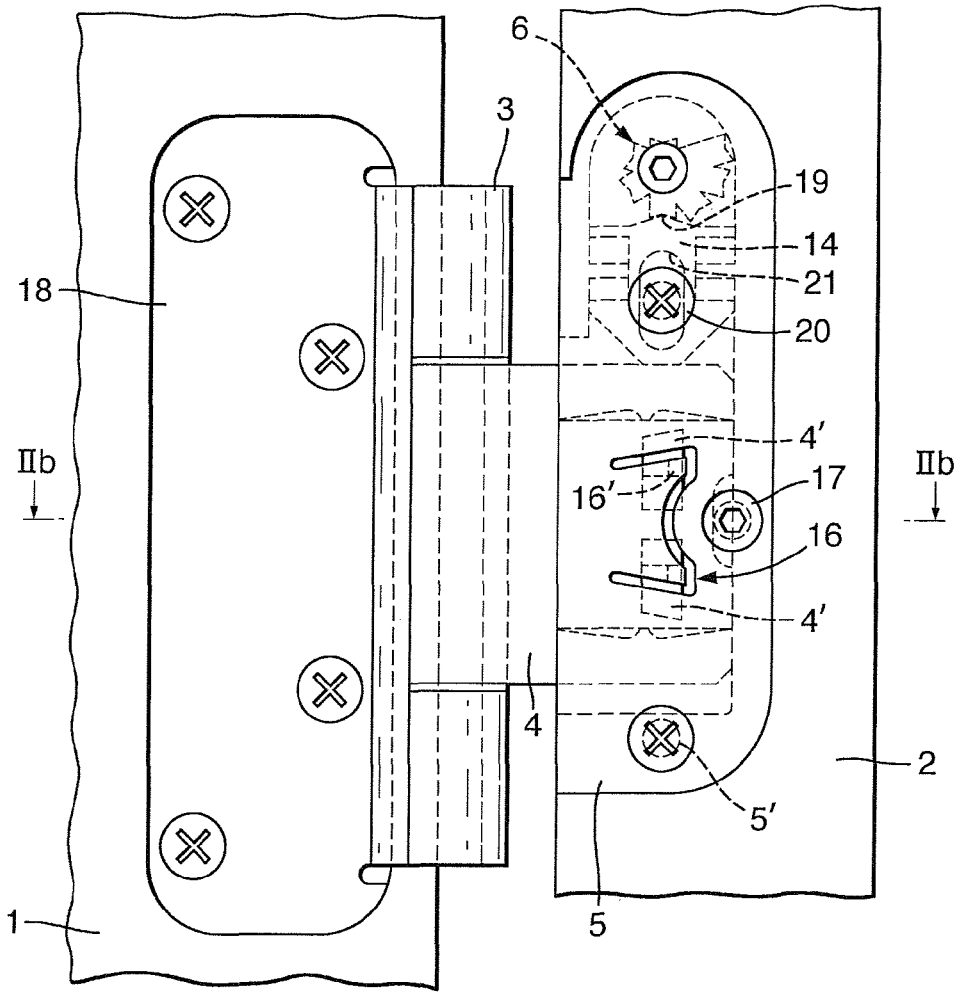

On the receiving part 5 which is fastened to the door 2 by screws, such as the screw 5', there is a projection 5" which is arranged to cooperate with a slide 14 that has upper hooks or projections 14' which rest on the projections 5" when the hinge members 3, 4 and 5 respectively are separated. When the hinge leaf 4 is inserted into the receiving part 5 in a pocket therein, the slide 14 is pushed upwards with maximum movement until contact portions or hooks 14" rest against the projections 5". The slide 14 will be moved upwards when the hinge leaf 4 bears against a bevelled edge portion 14'" on the slide 14 at a first point of contact 15, this point of contact 15 gradually moving downwards on the slide 14 as the hinge leaf 4 is pushed into the receiving part 5. The slide 14, on upward movement, will move until a pointed engaging portion 19 comes to rest against the one of the rods 10 which is vertically positioned pointing downwards. When the hinge leaf 4 is fully inserted into the receiving part 5', as indicated in FIG. 2, a snap-in function 16 will come into action, i.e., that a spring tongue 16' provided with bosses 16" on the receiving part 5 will snap into hole 4' in the hinge leaf 4.

Figure 2B:
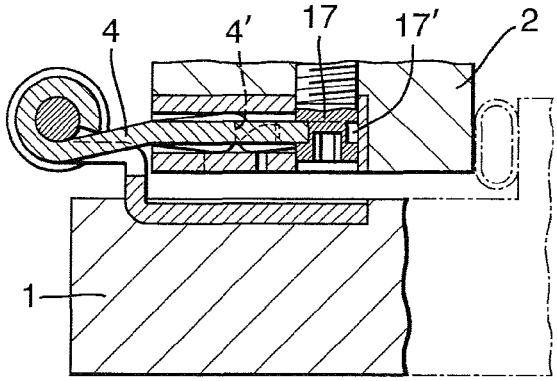
Fig.2b. Prior Art

In FIG. 2*b* it is shown how it may be possible to adjust the hinge laterally. The hinge leaf 4 in this figure has a waved or ridged portion 4' and at its free end a cut-out for engagement with a groove 1' in an adjusting screw 17. FIG. 2*b* thus shows the section IIb-IIb when the hinge member 18, upon the closing of the door 2 against the frame, remains lying essentially parallel against the receiving part 5.

Figure 3A:
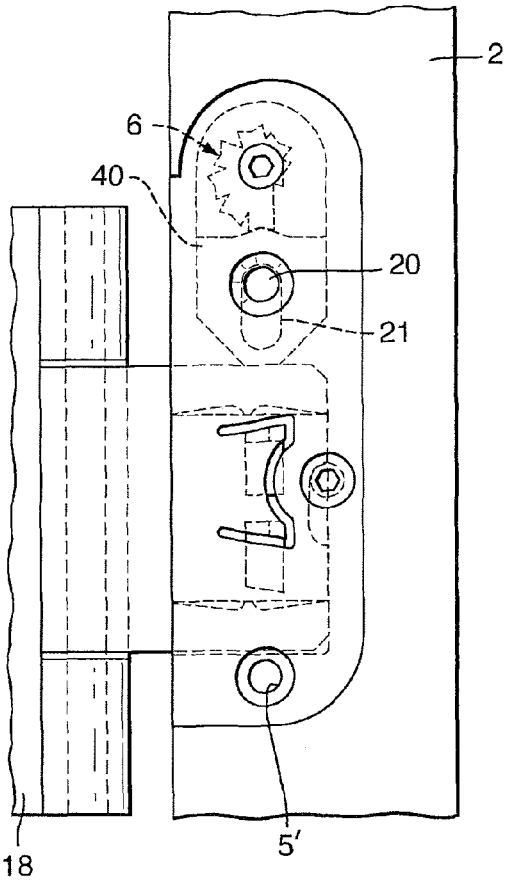
FIGS. 3*a* and 3*b* show the device illustrated in FIGS. 1 and 2 in additional height adjustment positions.

FIGS. 3 and 4 show different positions of the height adjustment device rod rotor 6 for an upper and a lower position, respectively.

Figure 4A:
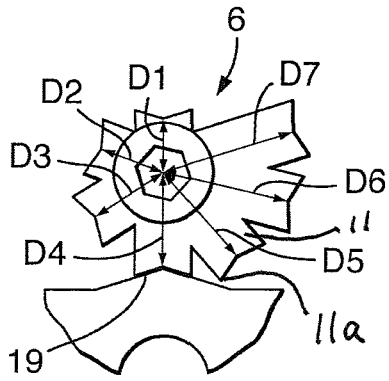
FIGS. 4*a*-4*c* show on an enlarged scale a detail of the height adjustment device of FIGS. 3*a* and 3*b;*
Figure 4B:
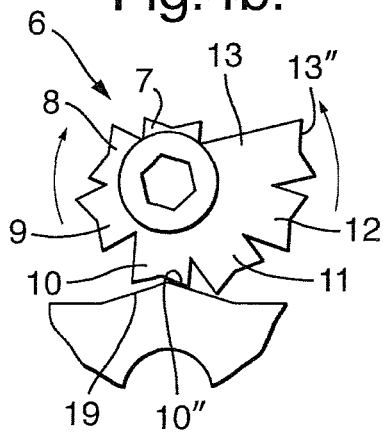
Figure 4C:
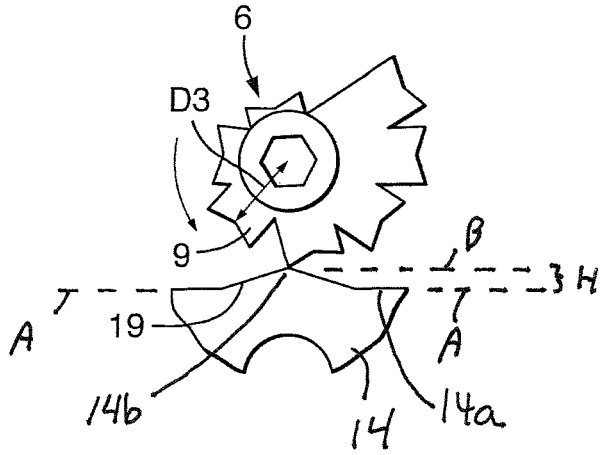

The rod rotor 6 is shown in more detail in FIGS. 4, 4*b* and 4*c* and is indicated in these figures in engagement with the pin or pointed engaging portion 19. The engaging portion 19 may, for example, have a pointed or curved shape, i.e., a V or a U shape, or a right-angled shape. The arms rods or pins 7-13 may respectively have different lengths D1-D7. The rod rotor 6, as shown in FIGS. 4*a*, 4*b* and 4*c*, is rotatable in one direction or the other, depending on whether the distance between the rotor center is to be made smaller or greater. In FIG. 4*c* it is shown how the rod rotor 6 can be turned counter-clockwise in order to bring a rod 9 having, for example, shorter length D3 down into engagement with the engaging portion 19.

Figure 6:
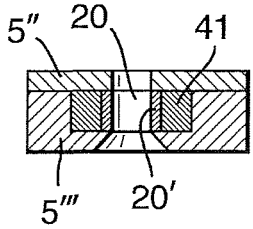
FIG. 6 shows section VI-VI on FIG. 3*b;*
Figure 7:
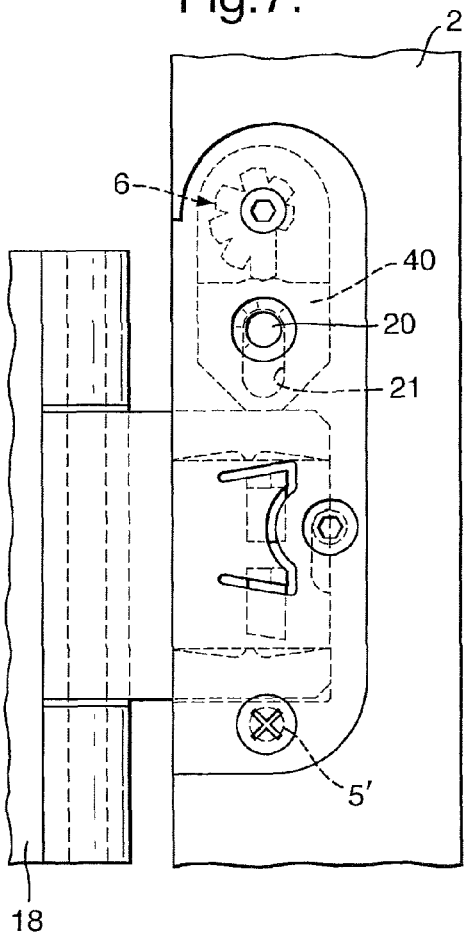
FIG. 7 shows the same view as on FIG. 3*a*, but with a slight modification of the height adjustment device.
Figure 8A:
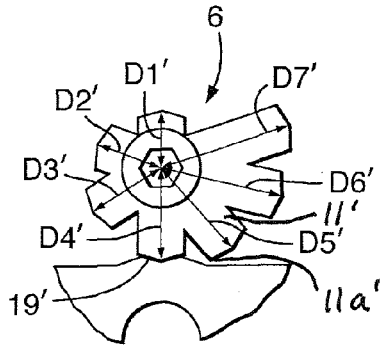
FIGS. 8*a*-8*c* show on an enlarged scale a detail of the height adjustment device of FIG. 7.
Figure 8B:
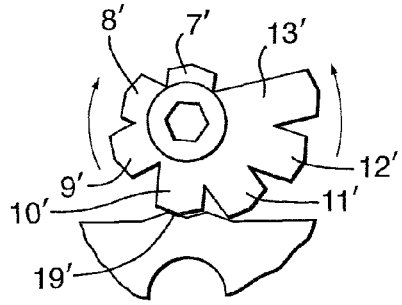
Figure 8C:
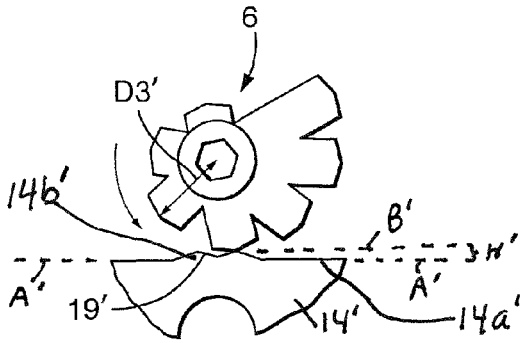

A modified rod rotor 6' and a modified upper part of the slide 40 are shown on FIG. 7 and in more detail on FIGS. 8*a*-8*c*. It is seen that the rotor 6' has a plurality of pointed arms or rods 7'-13' which are configured to selectively enter into engagement with a recessed portion 19' on the slide 40'. The pointed ends of the rods 7'-13' may have e.g. a shallow V or U shape, e.g. as indicated by 13'" on FIG. 8*a*, whereas the recessed portion 19' may have a corresponding shape to receive such rod end. The rods or pins 7'-13' may have different lengths D1'-D7', respectively. As for the embodiment of FIGS. 3*a*-6, the rod rotor 6', as shown on FIGS. 8*a*-8*c* is rotatable in one direction or the other, depending on whether the distance between the rotor center is to be made smaller or greater. In FIG. 8*c* it is shown how the rod rotor 6' can be turned counter-clockwise in order to bring a rod 9' having, for example, shorter length D3' down into engagement with the engaging portion 19'.

Thus, the embodiment of FIGS. 7 and 8*a*-8*c* are functionally operating in an equivalent manner to the embodiments shown on FIGS. 3*a*, 3*b*, 4*a*-4*c*, 5 and 6.

When the desired stepwise adjustable height of the door leaf 2 in relation to the frame 1 has thus been adjusted in the disclosed manner, a fixing screw 20 is tightened, but the slide 40 will still have possible free motion relative to the screw 20 via the elongate cut-out 21 in the slide 40. The screw 5' and the screw 20 thus serve to fasten the receiving part properly to the door leaf 2, whilst the slide 40 will still have free motion relative to the screw 20.

Figure 5:
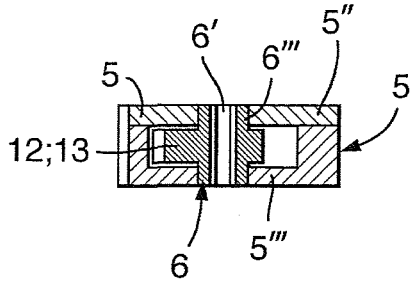
FIG. 5 shows section V-V on FIG. 3*b;*

As shown in FIG. 5, the height adjustment member has a spindle 6" which is supported in the two opposing side faces 5'", 5"" of the receiving part 5. As will be seen from all the figures, the screw 20; 50; 64 is positioned to be located closer to the upper edge of an inserted hinge leaf than the rotational axis of the height adjustment member.

Figure 3B:
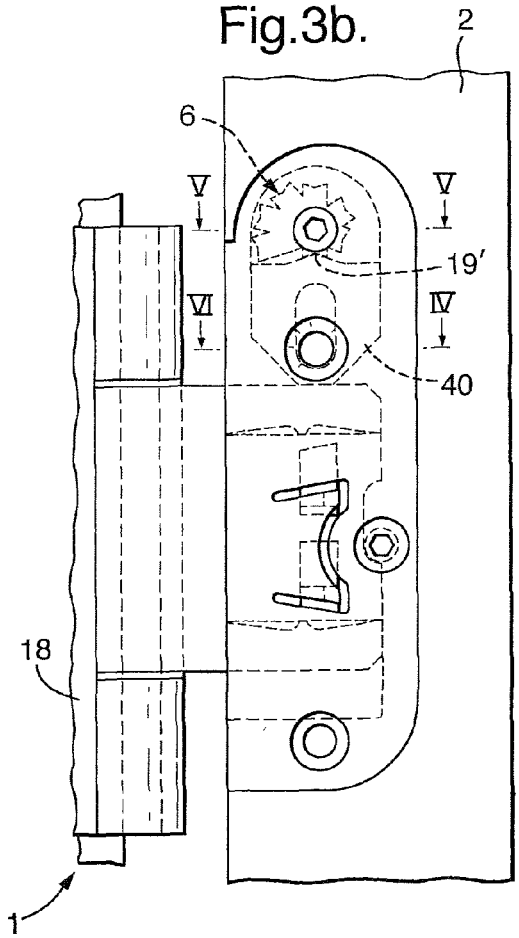

FIG. 6 shows the section VI-VI in FIG. 3*b*. Compared to FIG. 1, the stops 14', 14" and 5" cannot be found in FIG. 3*b*. Instead a spacer ring 20', which fits into the hole 21, is provided around the screw 20. The hole 21 must in any case be present, and the spacer ring therefore acts as an appropriate stop.

Figure 9A:
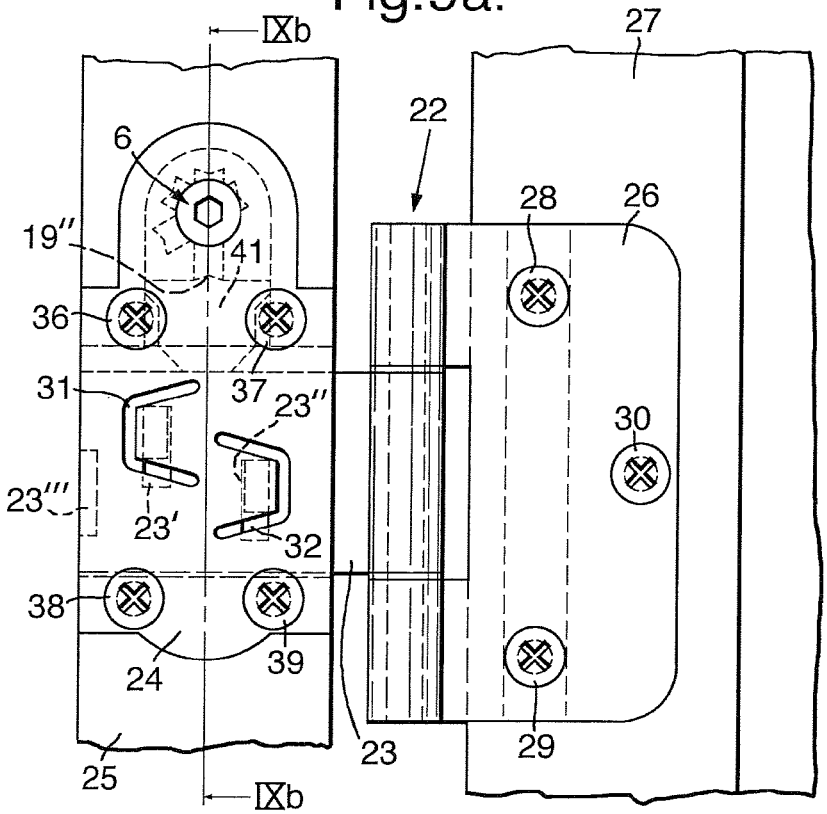
FIGS. 9*a* and 9*b* show the height adjustment device in connection with doors designed for the snapping in of the hinge leaf from the right or the left side, FIG. 9*b* being section IXb-IXb on FIG. 9*a;*
Figure 9B:
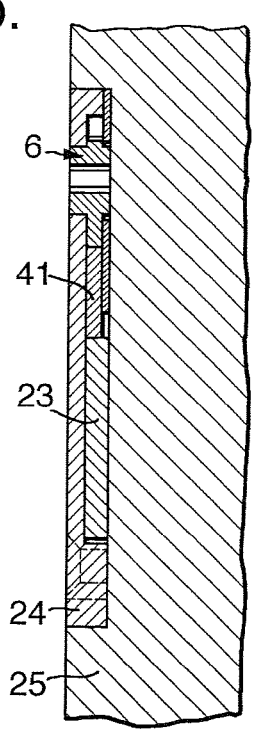

FIGS. 9*a* and 9*b* show a variant of that shown in the preceding figures, where there is a hinge 22 with a hinge leaf 23 that is designed for insertion into a receiving part 24 mounted on a door leaf 25, the hinge's 22 other hinge leaf 26 being fastened to a door frame 27 by three screws 28-30, of which screw 30 may serve as an adjusting screw for lateral adjustment of the hinge, as for example indicated correspondingly in FIG. 2*b* for the screw 17. The hinge 22 is designed to be inserted from either the right or the left side of the door leaf 25, depending upon how the hinge leaf 26 is fastened to the door frame 27, for example for a left or right opening door. Since the hinge leaf 23 can be inserted from one side or the other of the receiving part 24 in order to be able, via holes 23', 23" in the hinge leaf, to engage with snap elements 31, 32 on the receiving part 24, this results in a greater scope of application of the snap-in capability. This two-way snap-in insertability into the receiving part 24 is per se independent of the height adjustment that can be made.

Figure 10A:
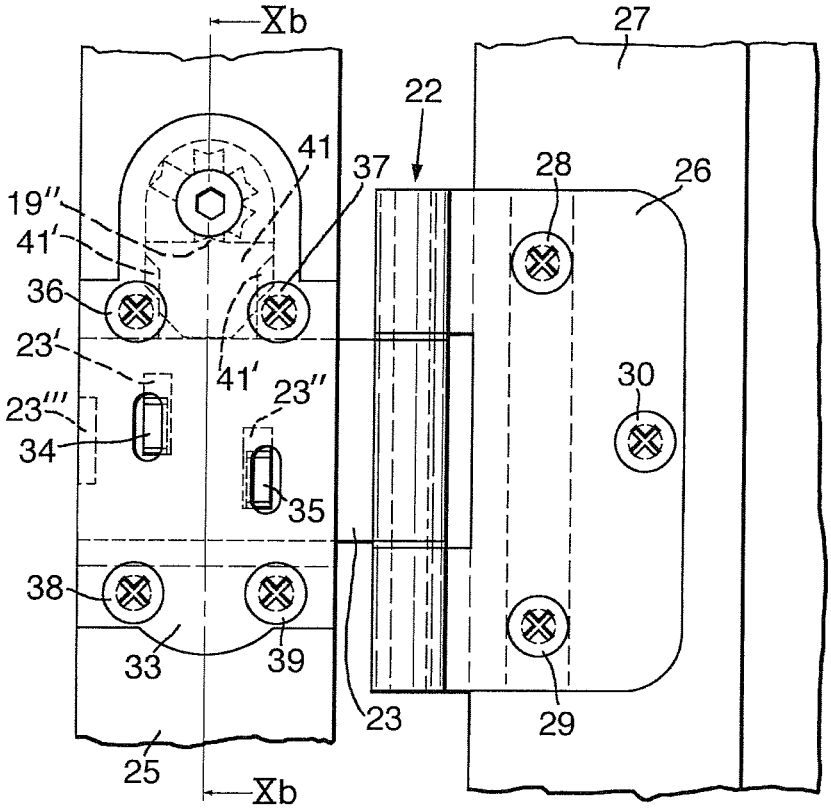
FIGS. 10*a* and 10*b* show a variant of the solution in FIGS. 9*a* and 9*b*, FIG. 10*b* being section Xb-Xb on FIG. 10*a;*
Figure 10B:
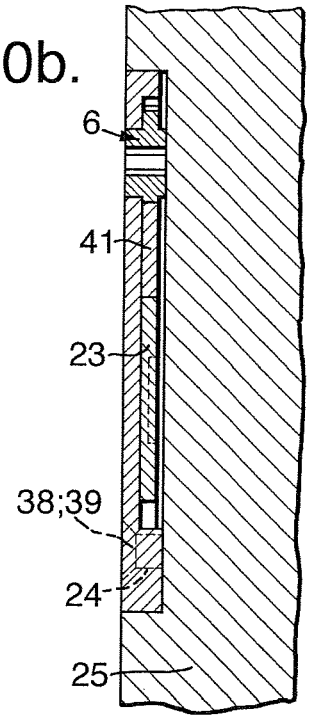

FIGS. 10*a* and 10*b* show a variant of the solution illustrated in FIGS. 9*a* and 9*b*, that is to say, a modified form of the receiving part, indicated in these figures by the reference numeral 33, attached to a door leaf 25 on which there are snap elements 34, 35 for engagement with respective holes 23', 23" in the hinge leaf 23 of the hinge 22. At the insertion end of the hinge leaf 23 there is provided an oblique bevel 23''' to enable the hinge leaf 23 to be passed more easily into the receiving part 33, the edge 23'''' of the hinge leaf 23 (see FIG. 11*b*) thus being prevented from striking against and thereby being impeded in its movement by the snap element 34 or 35 (depending on the insertion direction) upon insertion into the receiving part. The bevel 23''' shown in FIG. 9*a* has the same function relative to the snap elements 31, 32.

It will be seen from FIGS. 9*a* and 10*a* that the receiving part is fastened by four screws 36-39, of which the screws 36, 37 limit the downward movement of the slide 41, in that there are shoulders 41' on the slide which will bear against the said screws 36, 37. As the receiving part in this case is advantageously of a plastic material, the four fixing screws 36-39 are essential, but as the screws are fastened into solid material, there is no need for deflections or supporting rings. The use of four screws may be desirable with a receiving part of steel, but with sufficient rigidity of the steel, two screws are usually enough, as shown in FIG. 11.

When the receiving part is of plastic, it is advantageous to allow the snap engagement parts 31, 32; 34, 35 to be located on the upper side of the receiving part 24; 33. When the receiving part is of steel, a snap function will work badly as shown in FIG. 10, as the tiltable snap parts will quite simply be too stiff to lift in connection with engagement or disengagement.

Figure 11A:
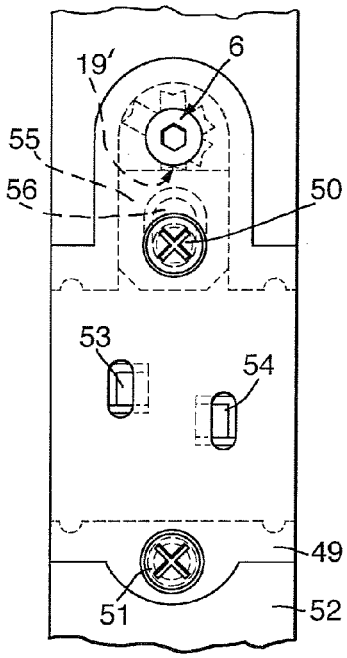
FIGS. 11*a*-11*d* show a modification of the device depicted in FIGS. 10*a* and 10*b;*
Figure 11B:
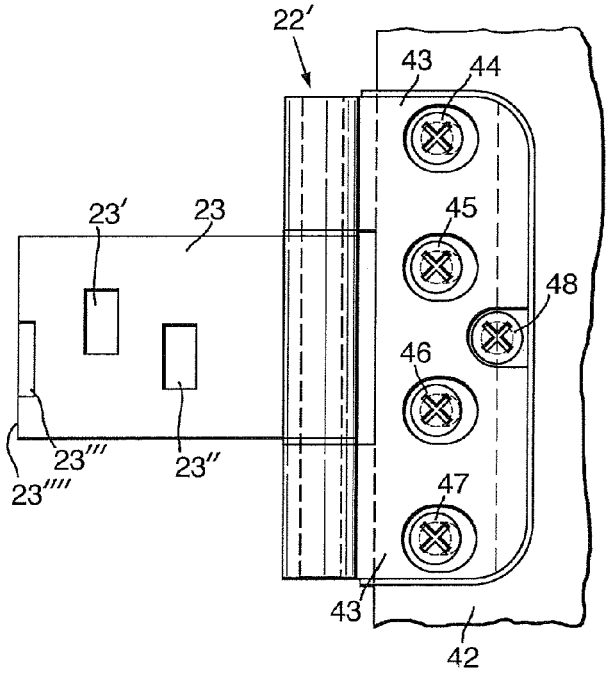
Figure 11D:
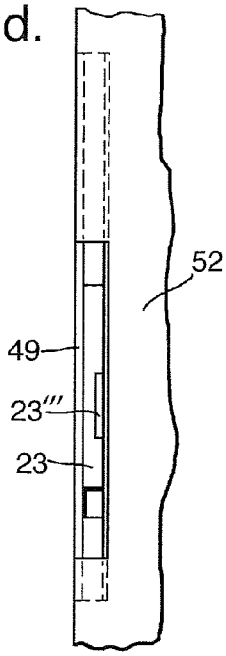
Figure 11C:
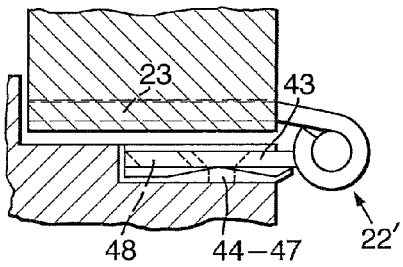

In the solution shown in FIGS. 11*a*-11*d* there is a hinge 22' with an insertion member 23 for snap fastening, as shown for FIGS. 10*a* and 10*b*. The hinge leaf that is to be secured in a door frame 42 is indicated by the reference numeral 43 and is fastened to the door frame by five screws 44-48, of which the screw 48 is an adjusting screw for lateral adjustment of the hinge, as shown in FIG. 2*b*, and where the screws 44-47 can be passed into elongate holes, so that there is also the possibility of depth adjustment of the hinge. The receiving part is indicated by the reference numeral 49 and in this case is chosen to be of metal, for instance steel, and may be fastened, for example, by two screws 50, 51 to a door leaf 52. As mentioned, it is then difficult to have the snap function in the upper side of the receiving part or, to be more precise, the side that faces away from the door leaf. Instead, it is proposed to provide engaging or snap elements 53, 54 in the underside of the receiving part, for example of 0.5 mm spring steel. The release of the hinge leaf is effected, as shown in FIGS. 11*a* and 11*b*, by pressing the engaging element 53 down, for example, with a screw driver, so that it is disengaged from the hole 23' in the hinge leaf 23. The slide which cooperates with the rod-shaped rotor 6 is in FIG. 11 indicated by the reference numeral 55 and has an elongate hole 56 which cooperates with the screw 50, as explained for the corresponding embodiment in FIGS. 4 and 7. FIG. 11*c* indicates how lateral adjustment may be effected, i.e., by loosening the screws 44-47 slightly, adjusting the screw 48 and then retightening the screws 44-47.

It is important to note that the two snap functions associated with the holes 23', 23" and related to the embodiment in FIGS. 9-11 are offset in a zigzag fashion, so that snap engagement does not take place in the wrong holes.

Figure 12A:
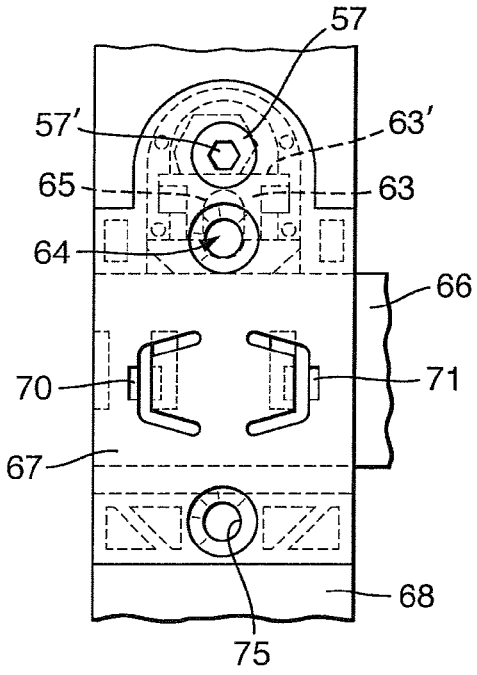
FIGS. 12*a*, 12*b* and 14 show another variant of the height adjustment as shown in FIGS. 9*a* and 9*b;*
Figure 12B:
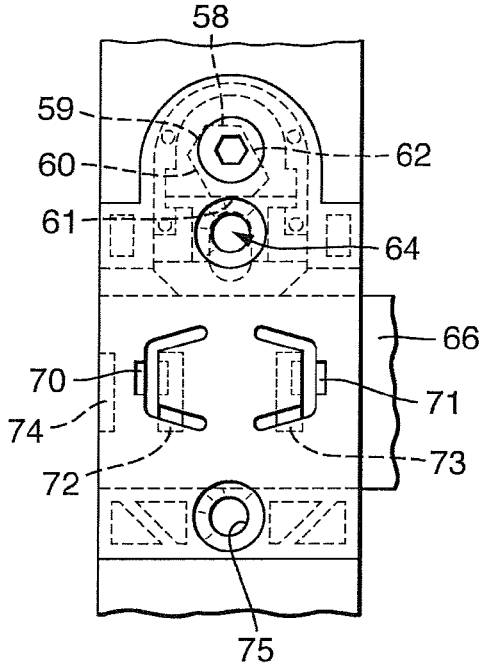
Figure 14:
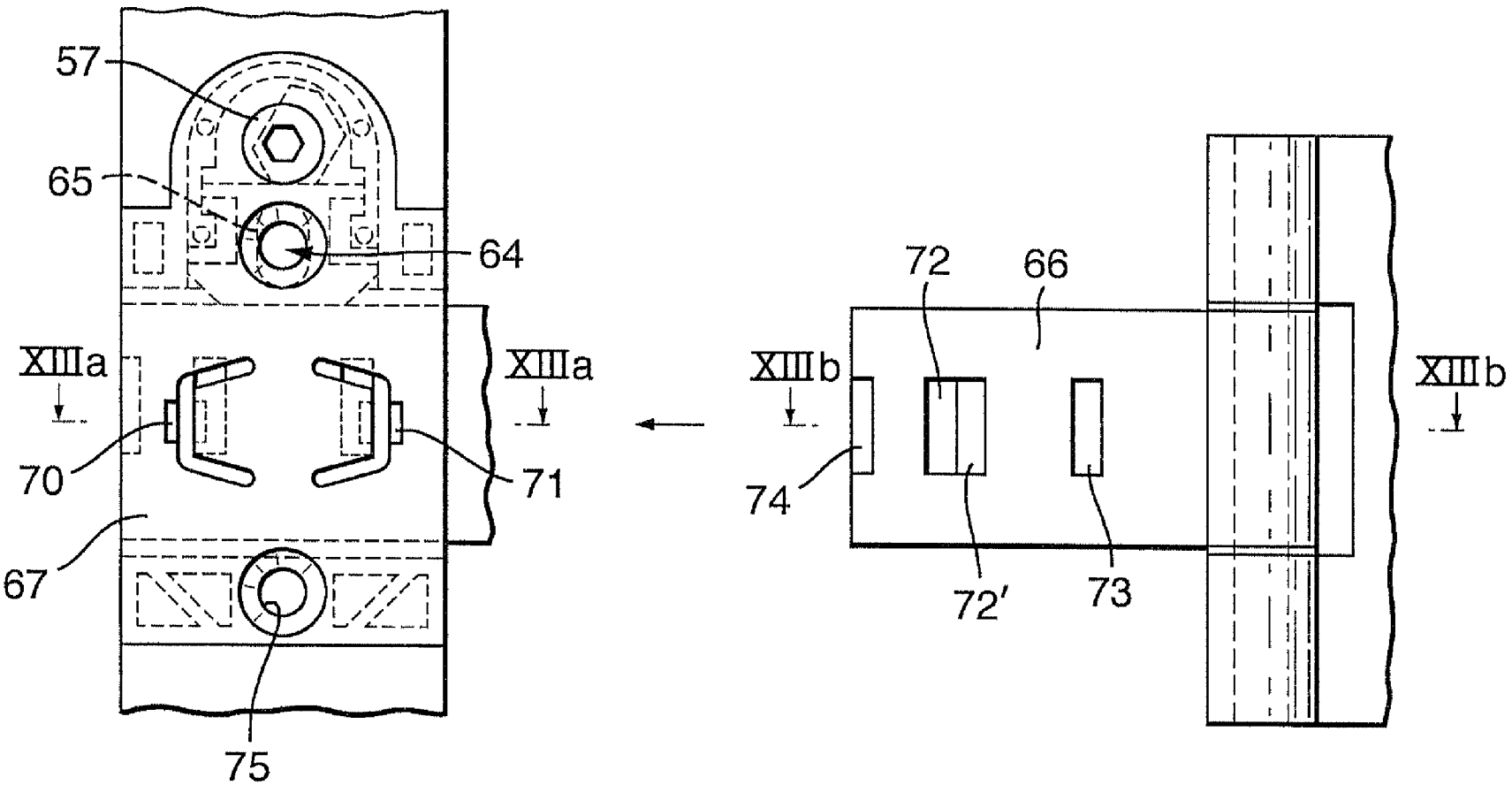

Such incorrect snap engagement could also easily have happened in the embodiment that can be seen from FIGS. 12*a*, 12*b* and 14.

A common feature of the solutions shown in connection with FIGS. 1-10 is thus that there is a plurality of radially directed, angularly separated rods or arms 6' of different lengths and wherein the end portion of such a rod or arm is adapted to engage with the pointed engaging portion 19; 19'; 19" on the upper edge of the slide 14; 40; 41; 55.

The invention will now be further described in connection with the embodiments that can be seen in FIGS. 12-14. The said rod rotor 6 with a plurality of radially directed, angularly separated arms or rods of different lengths, as shown in FIGS. 1-10, is in the embodiment in FIGS. 12 and 14 shown replaced by a polygonal disc 57 having a plurality of edges 58-62 (see FIG. 12*b*), each of which has mutually different spacing from the rotational centre 57' of the disc 57, and where such edges 58-62 are adapted so that any one selectively can bear against the upper edge 63' of the slide 63. The slide is movable relative to a screw 64 by means an elongate hole 65 in the slide 63. A further screw 75 secures the receiving part 67 to the door leaf 68. The insertable hinge leaf, indicated in these figures by the reference numeral 66, may be of a type that is capable of being snapped into the receiving part 67 from either the right or the left side of the door leaf 68 edge. When the desired vertical position of the door leaf 68 relative to a door frame has been set, the slide 63 will not be capable of being brought out of position from its abutment against an edge of the disc 57, provided the door leaf is not lifted up and the disc turned.

Figure 13A:
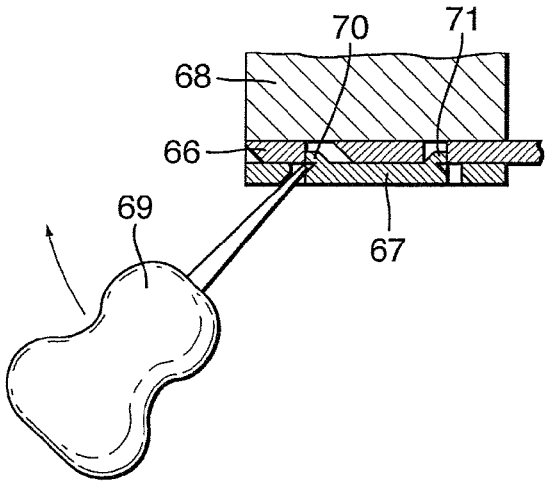
FIG. 13*a* shows the section XIIIa-XIIIa in FIG. 14.
Figure 13B:
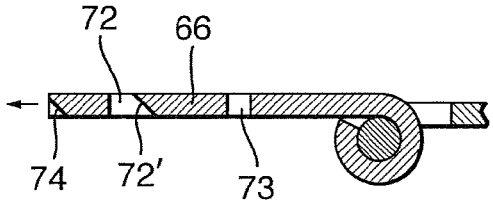
FIG. 13*b* shows the section XIIIb-XIIIb in FIG. 14, a longitudinal centre section of a hinge leaf for snap insertion into a hinge leaf receiving part.

FIGS. 13*a* and 13*b* show respectively how a snap-in door hinge leaf 66 which is located in the receiving part 67 on the door leaf 68 can be disengaged by using a tool 69 for upward tilting of an engaging tongue 70. The sections XIIIa-XIIIa and XIIIb-XIIIb in FIG. 14 refer to FIGS. 13*a* and 13*b* respectively To counter said possible incorrect snap engagement when the snap pins 70, 71 in the receiving part 67 do not lie in a zig zag path but in a straight line, it is important that the first or most forward hole 72 in the insertable hinge leaf 66 has a bevel 72', whilst the rear hole 73 should not have such a bevel. Similarly, the forward edge of the hinge leaf 66 may have a bevel.

Said projections or pins 5" as described, inter alia, in connection with FIGS. 1 and 2, but which can also be seen in FIGS. 12*a*, 12*b* which have a slide solution, will, when said screw 20; 64 is tightened, be adapted to limit the possible screwing in of the screw into the door leaf and thus the receiving part. This means that the slide will not become locked or clamped by such a screw and thus prevented from being able to be moved as required. The need for the use of a locking screw to secure the height adjustment member or the slide in the desired, set position also no longer applies.

FIGS. 1, 2*a*, 3 and 4 show that at the bottom the slide has the bevelled portion 14''' which is designed for sliding contact with a corresponding bevel 4" on the upper edge of the hinge leaf. However, such a bevel 4" is not absolutely necessary for the functionality and can, if desired, be omitted.

As will be seen from the illustrated embodiments, a line between the one of the arms or rods which is in engagement with the pointed engaging portion extends vertically and through the rotational axis of the height adjustment member. It is thus ensured that the height adjustment member cannot turn in the event of an accident. The hinge leaf will in any case be held in place against withdrawal from the receiving part by snap engagement.

Figure 15A:
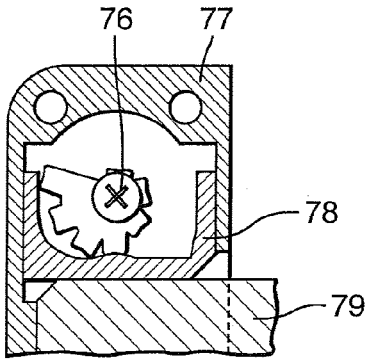
FIGS. 15*a*-15*c* show an alternative embodiment of a height adjustment device intended for abutment against the upper side of an insertable hinge leaf, wherein the height adjustment device is mounted on a door leaf.
Figure 15B:
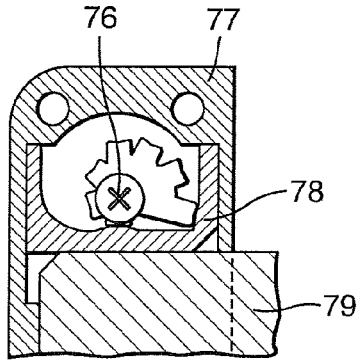
Figure 15C:
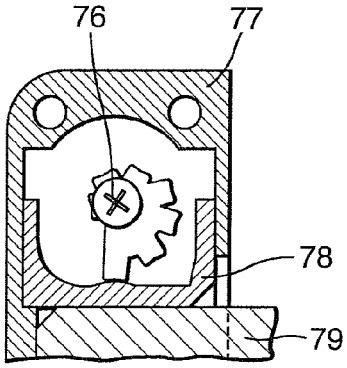

FIGS. 15*a*-15*c* show how a rod-shaped rotor 76 can be arranged in a receiving part 77 mounted on a door leaf of a door assembly and where slide 78 is arranged to rest against the upper edge of a snap-in or insertable hinge leaf 79.

Figure 16A:
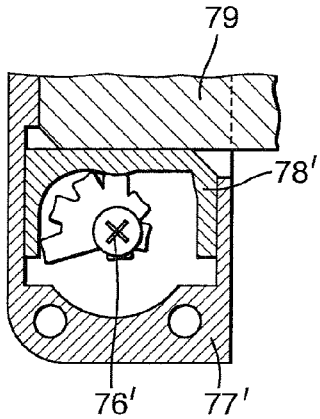
FIGS. 16*a*-16*c* show an alternative embodiment of a height adjustment device intended for abutment against the bottom of an insertable hinge leaf, wherein the height adjustment device is mounted on a door frame.
Figure 16B:
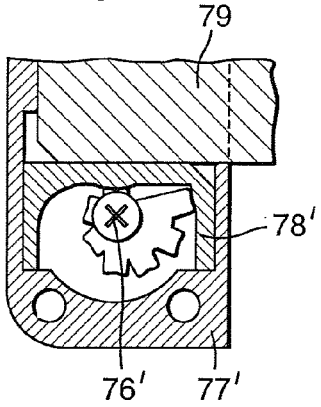
Figure 16C:
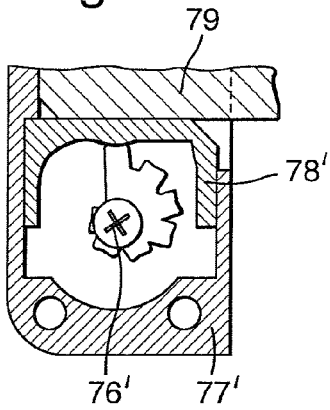

Similarly, FIGS. 16*a*-16*c* show how a rod-shaped rotor 76' can be arranged in a receiving part 77' and where a slide 78' is arranged to rest against the lower edge of a snap-in or insertable hinge leaf 79, the receiving part in this case being mounted in the frame part of the door assembly. The object of the solution shown in these figures is to make the adjustment member as short as possible in the vertical direction of the door.

Figure 17A:
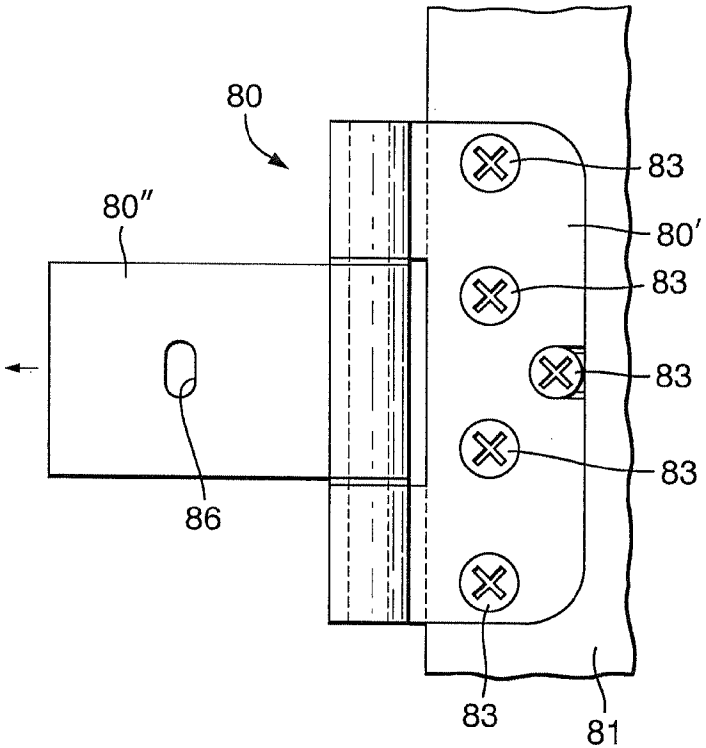
FIGS. 17*a*-17*c* show yet another alternative solution, where the hinge is not of the snap-in type, but has a hinge leaf that is insertable into a receiving part, and wherein the receiving part is mounted on the door frame.

FIG. 17*a* illustrates a solution wherein a hinge of the snap-in type is not used, but instead a hinge of the insertion type, but where the height adjustment device is nevertheless fully utilisable in a modified form A hinge 80 is shown in this figure having hinge leaf 80' for fastening to a door frame 81 by screws 83 and a hinge leaf 80" for insertion into a pocket 84' in a receiving part 84 on a door leaf 82, and where it is fastened by screw 85 which is passable through a hole 85' in the receiving part and an elongate hole 86 in the hinge leaf 80". The height adjustment mechanism, as previously described, consists of a rod-shaped "rotor" 87 having a plurality of rods or pins 88-92. The rods or pins are provided outermost with a recess, for example, having a pointed or curved shape, i.e., a V shape or a U shape, or a right-angled shape. In a similar way, there is provided a slide 93 having an engaging portion 94 adapted to the outer end of the rods or pins, i.e., having a corresponding pointed or curved shape, i.e., a V shape or a U shape, or a right-angled shape. The movement of the slide 93 is limited by the cooperation between a screw or pin 95 and an elongate opening 96 in the slide. The height adjustment mechanism is mounted in the receiving part housing 97, so that the "rotor" 87 is rotatably anchored therein and the slide 93 is slidable relative thereto. The screw 95 and additional screw 98 effect a fastening of respectively the height adjustment mechanism and said housing or cover 97 to the door leaf 82. On adjustment of the height-related position of the hinge leaf 80" on the door leaf 82, the fixing screws 85 and 95 can be loosened a little, so that the hinge leaf 80" and the slide 93 can thus be moved up or down in relation to the receiving part 84. When the right position has been set by means of the height adjustment mechanism 87 and the uppermost edge of the hinge leaf 80" bears against the free edge 93' of the slide, the screws 85 and 95 are tightened.

Figure 17B:
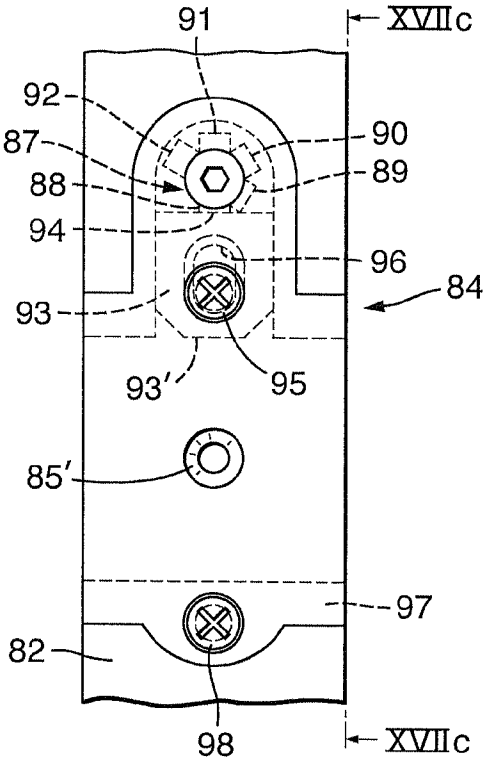
Figure 17C:
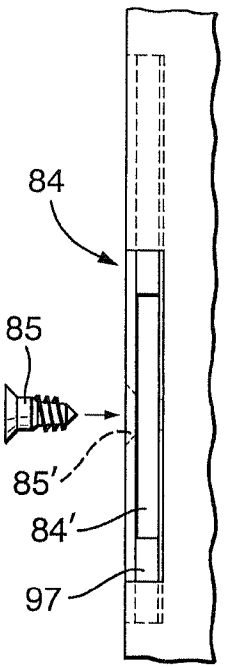
Figure 18:
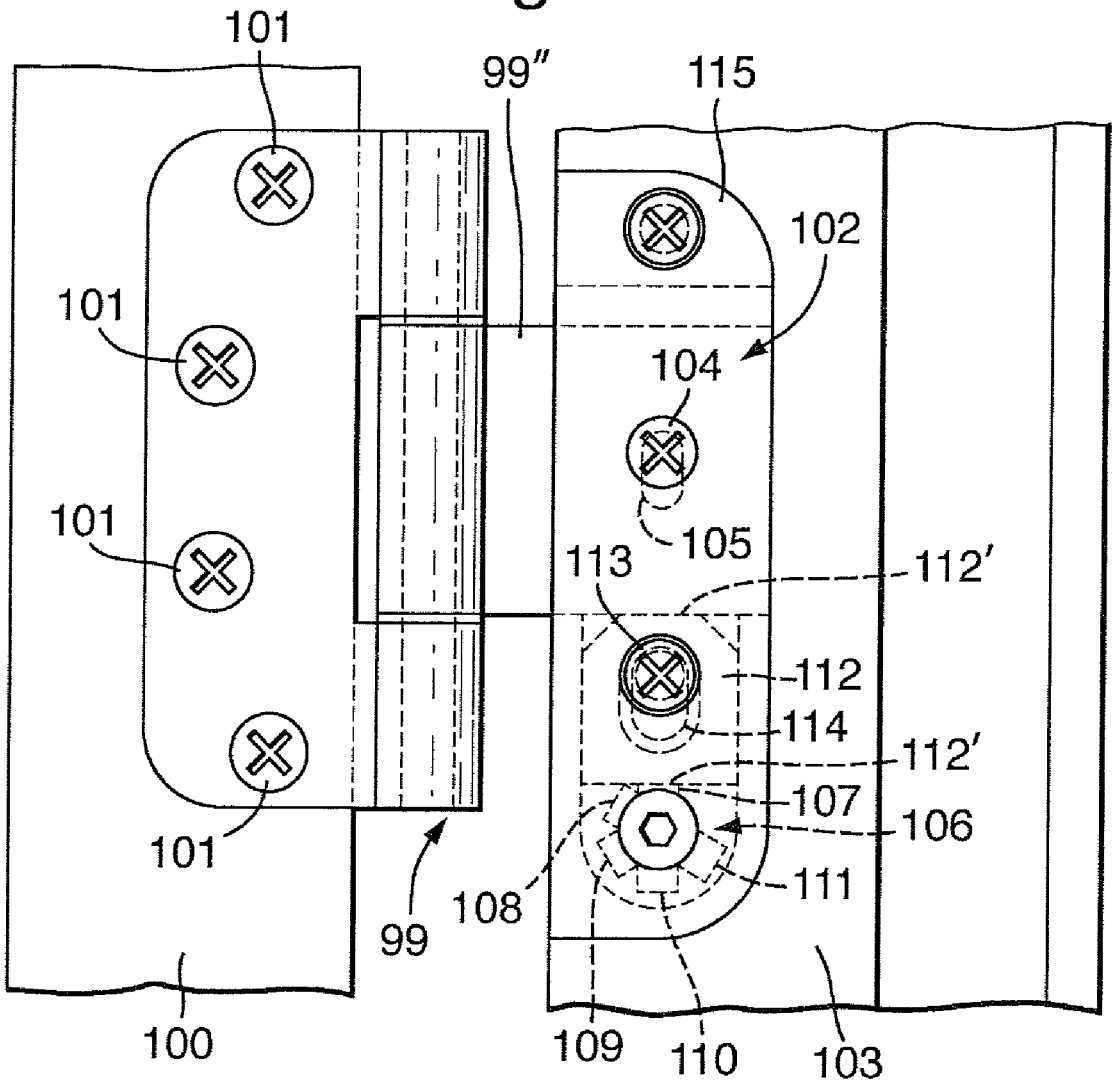
FIG. 18 shows a variant of the embodiment illustrated in FIGS. 17*a*-17*c*, where the hinge is not of the snap-in type, but has a hinge leaf that is insertable into a receiving part, and wherein the receiving part is mounted on the door leaf.

FIG. 18 illustrates a solution that is similar to that shown and explained in connection with FIGS. 17*a*-17*c*. A hinge 99 is shown in this figure with hinge leaf 99" for fastening to a door leaf 100 by screws 101, and a hinge leaf 80" for insertion into a receiving part 102 on a door frame 103 and which is fastened by screw 104 which can be passed through a hole in the receiving part and an elongate hole 105 in the hinge leaf 99". The height adjustment mechanism, as previously described, consists of a rod-shaped "rotor" 106 having a plurality of rods or pins 107-111. The rods or pins are provided outermost with a recess, for example, having a pointed or curved shape, i.e., a V shape or a U shape or a right-angled shape. In a similar way, there is provided a slide 112 having an engaging portion 112' adapted to the outer end of the rods or pins, i.e., having a corresponding pointed or curved shape, i.e., a V shape or a U shape, or a right-angled shape, or a shape as indicated on FIGS. 7 and 8*a*-8*c*. The movement of the slide 112 is limited by the cooperation between a screw or pin 113 and an elongate opening 114 in the slide. The height adjustment mechanism is mounted in the receiving part 102 housing 115, so that the "rotor" 106 is rotatably anchored therein and the slide 112 is slidable relative thereto. The screw 113 also effects a fastening of the height adjustment mechanism and a screw 116 secures said housing 115 to the door frame 82. On adjustment of the height-related position of the hinge leaf 99" on the door frame 103, the screws 104 and 113 can be loosened a little, so that the hinge leaf 80" and the slide 112 thus can be moved up or down in relation to the receiving part 102. When the right position has been set by means of the height adjustment mechanism 106 and the lowermost edge of the hinge leaf 80" bears against the free edge 112' of the slide, the screws 104 and 113 are tightened.

Figure 19:
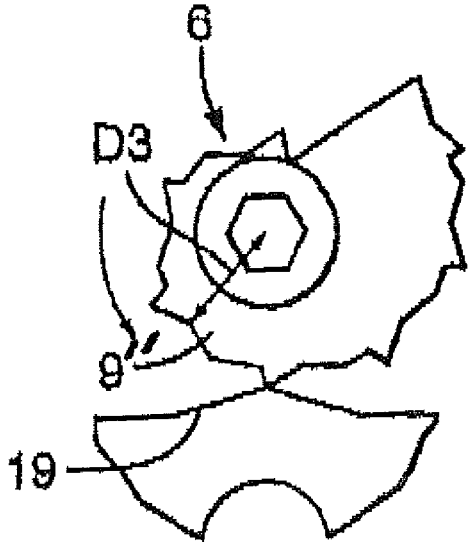
FIG. 19 is an enlarged detail of another embodiment of a portion of a height adjustment device.
Figure 20:
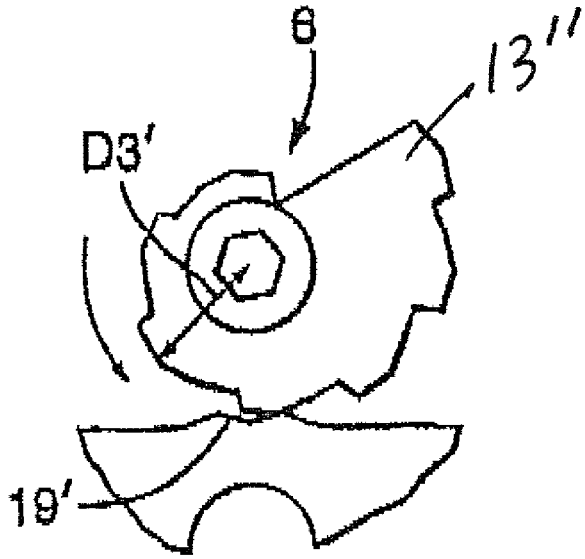
FIG. 20 is an enlarged detail of another embodiment of a portion of a height adjustment device.

It is understood that the arm rods or pins, such as shown in FIG. 4*b* as reference numerals 7 through 13, or 7' through 13' in FIG. 8*b* may also take on other configurations. These adjustment features may also incorporated into another embodiment as shown in FIGS. 12 and 14 and is represented by the polygonal disk 57 having a plurality of edges. The portion of the disk 57 from the center of rotation to the edges 58-62 are arms similar to arms/rods of the prior embodiments. Also, the edges 58-62 and the slide may also incorporate the engaging features of the previously discussed embodiments. Additional embodiments are also shown in FIGS. 19 and 20. It should be noted that the FIGS. 19 and 20 correspond relatively closely to the FIGS. 4*c* and 8*c*. However, the separations between the rods have been filled in between the adjustment features and forming more of a disk shape. In FIG. 9, the rotor 6 has a plurality of angularly separated features, one of which is indicated by reference numeral 9". Similarly, in FIG. 20, which corresponds close to FIG. 8*c*, the angularly separated features are again similar to the angularly separated features 7' through 13' but the spaces in between have filled in to still create a plurality of angularly separated features, one of which is indicated by reference numeral 13". It can therefore be seen that the angularly adjustable features as shown in FIGS. 19 and 20 form more of a disk, as opposed to the rods or arms shown in FIGS. 4*c* and 8*c*.

Referring now to FIG. 4*c*, there is shown the slide 14 having a second end 14*a*. The second end 14*a* is located at a height as shown by the dashed line labeled A. The engaging portion 19 is formed in an extension member 14*b*. The height of the extension member 14*b* is higher than that of the second end 14*a*. This difference is represented by the reference H.

Similarly, as shown in FIG. 8*c*, the slide 14' has a first end 14*a*'. The engaging portion 19' is positioned in the extension member 14*b*'. Similarly, the extension 14*b*' is at a height higher than the second end 14*a*'. While not discussed in detail, it can also be seen that the slides in FIGS. 19 and 20 are similarly constructed with an extension member on the slide.

The function of the extension member 14*b* and 14*b*' can be seen in viewing FIGS. 4*a* and 8*a*. It can be seen that the lower point 11*a*, 11*a*' of the arm or rod 11, 11' is at a height that is lower than the height of the extension 19, 19'. With the extension member 19, 19' being at a higher height than the second edge 14*a*, 14*a*', the lower point 11*a*, 11*a*' does not contact the slide 14, 14'. If there were no extension member, the lower point 11*a*, 11*a*' would contact the slide 14, 14'. Since this would not be acceptable, it would be necessary to place the arm 11, 11' at a greater angular space to allow suitable clearance. The extension 14*b*, 14*b*' allows for the rotor 6 to have more rods/arms having greater differences in length.

As previously described, the rotor of the present invention with the plurality of angularly plurality of selectable adjustment features, such as the rods or arms, have unequal lengths and center relative to the rotational center of the rotor, thereby avoiding harmful momentum of the rotor and the arm/rod engaging the slide. Further, the slide 14 has been provided with an engaging portion to fit or mate the end of the engaging rod/arm when they are engaged.

In the solutions shown it will be understood that the height adjustment device is stable when the door leaf hangs with its weight in cooperation with the device, but is adjustable when the door leaf is lifted up with force, and after any adjustment is lowered for setting the door leaf at a possible new desired height.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A height adjustment device for a door hinge, the device configured to be co-operative with the door hinge having hinge leaves attachable to a door leaf and a door frame, respectively, wherein the height adjustment device is configured to be installed on either the door leaf or the door frame to engage a dedicated one of the hinge leaves there at, wherein a rotary height adjustment mechanism of said device upon such engagement is adapted to bear against an adjacent, longitudinal edge on the dedicated one of the hinge leaves, and wherein the height adjustment mechanism comprises a rotary height adjustment member with a plurality of selectable adjustment features located at respective different distances from a rotation center of the rotary height adjustment member, the rotary height adjustment mechanism comprises a limitedly movable slide and the rotary height adjustment member, wherein the slide has a first end configured for abutment against said longitudinal edge of the hinge leaf; and that the rotary height adjustment member has a rotor with the plurality of radially directed, angularly separated features of different lengths, wherein an end portion of such a feature, upon rotation of the rotary height adjustment member to a required rotary position, is adapted to releasably engage with an engaging portion at a second end of the slide that is opposite said first end of the slide, wherein the slide insulates the rotary height adjustment member from the one of the hinge leaves.

2. The height adjustment device as disclosed in claim 1 wherein a line through the one of said features on the height adjustment member that engages said engaging portion extends vertically and through the rotation center of the height adjustment member;

that the slide has limited movability in a receiving part, and that the dedicated hinge leaf is attachable in the receiving part with limited vertical movability therein.

3. A height adjustment device as disclosed in claim 1, the rotary height adjustment member having recesses having a pointed shape and pins having a corresponding shape.

4. A height adjustment device as disclosed in claim 1, characterised in that the slide at its first end has at least one bevelled portion designed for sliding contact with a bevel or a corner on a forward part of the hinge leaf.

5. A height adjustment device as disclosed in claim 1, characterised in that a line through one of the features which engages said engaging portion, a pin or recess thereon, and through an adapted recess or pin on the slide extends vertically and through a rotational axis of the rotor.

6. A height adjustment device as disclosed in claim 1, characterised in that the slide has a cut-out along a portion of the longitudinal edges of the slide, wherein said cut-out cooperates with projections on the receiving part for limiting the up or down movement of the slide.

7. A height adjustment device as disclosed in claim 1, characterised in that the height adjustment member has a spindle that is supported in the two opposing side faces of the receiving part.

8. A height adjustment device as disclosed in claim 6, characterised in that said projections, upon the tightening of said screw, are adapted to limit the possible screwing in of a fixing screw into the door leaf and thus the receiving part.

9. A height adjustment device as disclosed in claim 1, characterised in that a fixing screw is located closer to an inserted hinge leaf's upper edge than to the rotation center of the rotary height adjustment member.

10. A height adjustment device as disclosed in claim 1, characterised in that an insertion end of the hinge leaf has a bevel in order, on the insertion of the hinge leaf into the receiving part, to push a snap element in the receiving part to the side before it is then allowed to snap into a notch in the hinge leaf.

11. A height adjustment device as disclosed in claim 1, characterised in that the receiving part has snap engagement elements that are positioned offset horizontally and vertically relative to each other.

12. A height adjustment device as disclosed in claim 1, characterised in that the receiving part has snap engagement elements that are positioned offset horizontally, but not vertically relative to each other.

13. A height adjustment device as disclosed in claim 12, characterised in that the insertable hinge leaf has engaging holes designed for snap engagement with said snap engagement elements; and that one of the engaging holes closest to the free end of the hinge leaf has a bevel at its rear portion.

14. A height adjustment device as disclosed in claim 1, characterised in that the slide has an elongate cut-out designed for free motion and selective engagement with a screw in the receiving part.

15. A height adjustment device as disclosed in claim 14, characterised in that the screw together with a mounted spacer ring which fits into the cut-out is adapted to limit the vertical movement of the slide in the receiving part.

16. A height adjustment device as disclosed in claim 1, characterised in that said first end is a downward facing edge on the slide; and that the longitudinal edge on the hinge leaf is the upper edge of the hinge leaf.

17. A height adjustment device as disclosed in claim 1, characterised in that said first end is an upward facing edge on the slide; and that the longitudinal edge of the hinge leaf is the lower edge of the hinge leaf.

18. A height adjustment device as disclosed in claim 2, wherein the features are rods.

19. A height adjustment device as disclosed in claim 2, wherein the features are arms.

20. The height adjustment device as disclosed in claim 2, the rotary height adjustment member having recesses having a curved shape and pins having a corresponding shape.

21. The height adjustment device as disclosed in claim 2, the rotary height adjustment member having recesses having an angled shape and pins having a corresponding shape.

22. A height adjustment device for a door hinge, the device configured to be cooperative with the door hinge having hinge leaves attachable to a door leaf and a door frame, respectively, wherein the height adjustment device is configured to be installed on either the door leaf or the door frame to engage a dedicated one of the hinge leaves there at, wherein a rotary height adjustment mechanism of said device upon such engagement is adapted to bear against an adjacent, longitudinal edge on the dedicated one of the hinge leaves, and wherein the height adjustment mechanism comprises a rotary height adjustment member with a plurality of selectable adjustment features located at respective different distances from a rotation center of the rotary height adjustment member, the rotary height adjustment mechanism comprises a limitedly movable slide and the rotary height adjustment member, wherein the slide has a first end configured for abutment against said longitudinal edge of the hinge leaf; and that the rotary height adjustment member has a rotor with the plurality of radially directed, angularly separated features of different lengths, the slide having a second end for abutting the angularly separated features, the second end having an extension member that extends beyond the second end, the second end opposite the first end, wherein an end portion of such a feature, upon rotation of the rotary height adjustment member to a required rotary position, is adapted to abut the extension member, wherein the slide insulates the rotary height adjustment member from the one of the hinge leaves.

* * * * *